US010323206B2

(12) United States Patent
Fish

(10) Patent No.: US 10,323,206 B2
(45) Date of Patent: Jun. 18, 2019

(54) LUBRICATING GREASE COMPOSITION

(71) Applicant: The Lubrizol Corporation, Wickliffe, OH (US)

(72) Inventor: Gareth Fish, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/546,899

(22) PCT Filed: Jan. 26, 2016

(86) PCT No.: PCT/US2016/014855
§ 371 (c)(1),
(2) Date: Jul. 27, 2017

(87) PCT Pub. No.: WO2016/123067
PCT Pub. Date: Aug. 4, 2016

(65) Prior Publication Data

US 2018/0023023 A1 Jan. 25, 2018

Related U.S. Application Data

(60) Provisional application No. 62/110,051, filed on Jan. 30, 2015.

(51) Int. Cl.

| | |
|---|---|
| ***C10M 105/00*** | (2006.01) |
| ***C10M 117/04*** | (2006.01) |
| ***C10M 139/00*** | (2006.01) |
| ***C10M 169/00*** | (2006.01) |
| ***C10M 169/06*** | (2006.01) |

(52) U.S. Cl.
CPC ..... *C10M 169/00* (2013.01); *C10M 105/00* (2013.01); *C10M 117/04* (2013.01); *C10M 139/00* (2013.01); *C10M 169/06* (2013.01); *C10M 2203/003* (2013.01); *C10M 2203/1006* (2013.01); *C10M 2203/1025* (2013.01); *C10M 2203/1065* (2013.01); *C10M 2207/1256* (2013.01); *C10M 2207/1285* (2013.01); *C10M 2227/06* (2013.01); *C10M 2227/061* (2013.01); *C10M 2227/062* (2013.01); *C10N 2210/01* (2013.01); *C10N 2210/02* (2013.01); *C10N 2230/08* (2013.01); *C10N 2230/34* (2013.01); *C10N 2230/76* (2013.01); *C10N 2240/02* (2013.01); *C10N 2250/10* (2013.01)

(58) Field of Classification Search
CPC ..... C10M 2207/1206; C10M 2227/061
USPC ..... 508/185
See application file for complete search history.

(56) References Cited

U.S. PATENT DOCUMENTS

| | | | | |
|---|---|---|---|---|
| 2,815,325 | A | 12/1957 | Pohorilla et al. | |
| 4,600,517 | A | 7/1986 | Doner et al. | |
| 2007/0107000 | A1 | 5/2007 | Peng | |
| 2010/0269781 | A1 * | 10/2010 | Derevjanik ..... | C10M 163/00 123/196 R |
| 2014/0107000 | A1 | 4/2014 | Ivancic et al. | |

FOREIGN PATENT DOCUMENTS

| | | | |
|---|---|---|---|
| EP | 0176202 | A1 | 4/1986 |
| RU | 2483100 | C1 | 5/2013 |

OTHER PUBLICATIONS

European Patent Office, International Search Report for PCT/US16/014855, dated Apr. 15, 2016.
European Patent Office, Written Opinion for PCT/US16/014855, dated Apr. 15, 2016.

* cited by examiner

*Primary Examiner* — Vishal V Vasisth
(74) *Attorney, Agent, or Firm* — Eryn Ace Fuhrer; Teresan W. Gilbert

(57) ABSTRACT

The invention provides a lubricating grease composition comprising an oil of lubricating viscosity, a metallic soap thickener and a boron-containing compound, wherein the boron containing compound comprises a borate ester comprising at least one alkyl group having a branch at the β position or higher. The invention further relates to a method of lubricating a mechanical device with the lubricant composition.

15 Claims, No Drawings

LUBRICATING GREASE COMPOSITION

CROSS REFERENCE TO RELATED APPLICATION

This application claims priority from PCT Application Serial No. PCT/US2015/014855 filed Jan. 26, 2016 which claims the benefit of U.S. Provisional Application No. 62/110,051 filed on Jan. 30, 2015, the entirety of both of which is hereby incorporated by reference.

FIELD OF INVENTION

The invention provides a lubricating composition containing an oil of lubricating viscosity and a boron containing compound, which may comprise a borate ester comprising at least one alkyl group having a branch at the 0 or higher position. The invention further relates to the use of the lubricating composition in a grease application.

BACKGROUND OF THE INVENTION

Lubricating greases are generally defined by two properties. One is the consistency of the grease. Because a lubricating grease is a non-Newtonian semi-solid material, viscosity cannot be measured in the same way that a measurement would be made for a liquid lubricant. Rather, the "consistency" of a grease refers to how stiff the grease is under prescribed test conditions. Grease consistency is measured by a cone penetration test. Such tests are defined by various standards such as ISO 2137, ASTM D217, or ASTM D1403. The results of this test allow a consistency class e.g. #2 to be assigned to the grease according to a classification system established by the NLGI (formerly known as the National Lubricating Grease Institute). Softer greases will generally have a higher penetration number according to cone penetration tests. Comparisons of grease properties are generally done for greases in the same consistency class.

The other significant property used to define a lubricating grease is the dropping point. The dropping point is the temperature at which grease becomes soft enough to allow oil and material to separate from the matrix of the grease and fall from the orifice of the testing apparatus. The dropping point of a grease can be measured by various tests, such as ISO 2176 (ASTM D566), ASTM D2265, or IP 396 Automatic Dropping point test. The dropping point may be indicative of the upper operating temperature of the grease.

Simple soaps are known to be used to thicken lubricating oils in order to make grease compositions. Simple soaps are usually defined as the reaction product of a single fatty acid with an alkali source. The fatty acids can be derived from natural oils from plant and animal sources. A common fatty acid derived from plant sources is oleic, while one from animal sources is stearic. Both of these $C_{18}$ acids have a hydrocarbyl tails attached to a single carboxylic acid head group. Another commonly used fatty acid is 12-hydroxystearic acid. This fatty acid is derived from hydrogenating castor oil. Simple soaps generally have dropping points which are similar to the melting temperature of the simple soap.

The dropping point of simple soaps can be increased in a process known as "complexing" which involves reacting the simple soap thickener with a complexing agent, such as dicarboxylic acids with 6 to 12 carbon atoms, for instance sebacic ($C_{10}$) acid or azelaic ($C_9$) acid. Complexing with the diacids results in increased cost of the overall grease product and can negatively impact the flow properties of the grease especially, at low temperature.

Boron containing compounds have been used as dropping point enhancers for greases made with simple soap thickeners to replace the complexing diacids. Boric acid has been found to be difficult to incorporate into the grease and the resulting greases are not as thermally stable as those made with the dicarboxylic acids. Some low molecular weight ($C_4$ to $C_8$) borate esters have been found to be able to be incorporated into greases, but have other issues. Borate esters are generally hydrolytically unstable and readily react with moisture in the air, which liberates alcohols from the borates to also produce boric acid. The use of these borate esters causes strong alcohol odors in the finished grease.

Therefore, there is a need to provide a high dropping point, metal simple-soap thickened grease composition comparable to, or superior to, what is currently achievable via standard grease "complexing" technology, but which avoids the notable drawbacks of difficult incorporation, strong alcohol odors, and poor grease flow properties at low temperatures.

SUMMARY OF THE INVENTION

The present invention provides a lubricating grease composition comprising an oil of lubricating viscosity, a metallic soap thickener, and boron containing compound.

In one embodiment, the invention provides a lubricating grease composition comprising an oil of lubricating viscosity, a metallic soap thickener and a boron containing compound, wherein the boron containing compound comprises a borate ester.

In one embodiment, the invention provides a lubricating grease composition comprising an oil of lubricating viscosity, a metallic soap thickener and a boron containing compound, wherein the boron containing compound comprises a borate ester, wherein the borate ester comprises at least one alkyl group having a branch at the β position or higher.

In one embodiment, the invention provides a lubricating grease composition comprising an oil of lubricating viscosity, a metallic soap thickener and a borate ester comprising at least one alkyl group having about 10 to about 32 carbon atoms, wherein the alkyl group has a branch at the β position or higher.

In one embodiment, the invention provides a lubricating grease composition comprising an oil of lubricating viscosity, a metallic soap thickener and a borate ester comprising at least one alkyl group having about 10 to about 32 carbon atoms, the alkyl group having a branch at the β or higher position, wherein the alkyl group has a structure represented by $—CH_2—C(R^1)(R^2)H$, where $R^1$ is an alkyl group of about 7 to about 18 carbon atoms and $R^2$ is an alkyl group having fewer carbon atoms than $R^1$.

In one embodiment, the invention provides a lubricating grease composition comprising an oil of lubricating viscosity, a metallic soap thickener and a borate ester comprising at least one alkyl group having about 10 to about 32 carbon atoms, said alkyl group having a branch at the β or higher position, wherein the alkyl group is derived from a Guerbet alcohol.

The invention also provides a method for lubricating a mechanical device. Such method comprises supplying to a mechanical device a lubricating grease composition comprising an oil of lubricating viscosity, a metallic soap thickener and a boron containing compound, wherein the boron containing compound comprises a borate ester, wherein the borate ester comprises at least one alkyl group having a branch at the β position or higher.

DETAILED DESCRIPTION OF THE INVENTION

The invention described herein provides a lubricating grease composition which comprises an oil of lubricating viscosity, a metallic soap thickener, and a boron containing compound. In one embodiment, the lubricating grease composition consists essentially of an oil of lubricating viscosity, a metallic soap thickener, and a boron containing compound. In another embodiment, the lubricating grease composition consists of an oil of lubricating viscosity, a metallic soap thickener, and a boron containing compound. The invention also includes a method for lubricating a mechanical device using a lubricant composition, which comprises an oil of lubricating viscosity, a metallic soap thickener, and a boron containing compound.

Oils of Lubricating Viscosity

The lubricating grease in accordance with the present invention will comprise at least one oil of lubricating viscosity. In one useful embodiment, grease composition comprises at least 50% by weight, for example at least 60% by weight, further for example, at least 70% by weight, and even further for example, at least 80% by weight, of the oil of lubricating viscosity based on the total weight of the grease composition.

Oils useful in the present invention include, but are not limited to, natural oils and synthetic fluids, oil derived from hydrocracking, hydrogenation, and hydro-finishing, unrefined, refined, re-refined oils or mixtures thereof.

Natural oils useful in making the inventive lubricants include animal oils, vegetable oils, mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized or oligomerized olefins (e.g., polybutylenes, polypropylenes, propylene-isobutylene copolymers); poly(l-hexenes), poly(l-octenes), trimers or oligomers of l-decene e.g., poly(l-decenes), such materials being often referred to as poly {α-olefins, and mixtures thereof; alkyl-benzenes (e.g. dodecylbenzenes, tetradecylbenzenes, di-nonylbenzenes, di-(2-ethylhexyl)-benzenes); polyphenyls (e.g., biphenyl s, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as PRIOLUBE®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Oils of lubricating viscosity may also be defined as specified in the April 2008 version of "Appendix E—API Base Oil Interchangeability Guidelines for Passenger Car Motor Oils and Diesel Engine Oils", section 1.3 Subheading 1.3. "Base Stock Categories". The API Guidelines are also summarised in U.S. Pat. No. 7,285,516 (see column 11, line 64 to column 12, line 10). In one embodiment the oil of lubricating viscosity may be an API Group I, Group II, Group III, Group IV, Group V oil, or mixtures thereof. The oil could also be "re-refined" oil.

The amount of the oil of lubricating viscosity present is typically the balance remaining after subtracting from 100% by weight the sum of the amount of the grease thickener, the boron containing compound, and any other optional performance additives in the composition. A lubricating grease composition in accordance with the present invention grease may contain as much as 50% by weight or 60% by weight or 70% by weight, or 80% by weight or 90% by weight or even 95% by weight of an API base oil of lubricating viscosity.

Thickener

Thickeners useful in the present invention include simple metallic soap grease thickeners, metal salts of such acid-functionalized oils, or mixed soap thickeners in which one fatty acid is reacted with two different metals In one embodiment, the metallic soap grease thickener may be a lithium soap. In another embodiment, the metallic soap grease thickener may be a calcium soap. In still another embodiment, the grease thickener may be a mixed lithium and calcium metallic soaps. In another embodiment, the grease thickener may be a sodium soap.

In one embodiment, the fatty acid used in the manufacture of the metallic soap thickener is derived from a natural plant or animal oil. Examples of plant derived acids are oleic acid, 12-hydroxystearic acid, and ricinoleic acid. Hydrogenated castor oil, an impure derivative of castor oil containing glycerol, glycerides and 12-hydroxystearic acid may also be useful in preparing metallic soap thickeners. An example of animal derived fat is beef tallow.

The lubricating grease composition of the present invention may include from about 0.1% by weight to about 45% by weight, or about 1% by weight to about 40% by weight, or about 1% by weight to about 20% by weight, or about 1% by weight to about 25% by weight of the metallic soap thickener.

The Boron-Containing Compound

In one embodiment the lubricating composition of the invention includes a boron-containing compound. In one embodiment, the boron-containing compound includes a borate ester or a borated alcohol.

Borate esters may be prepared by the reaction of a boron compound and at least one compound selected from epoxy compounds, halohydrin compounds, epihalohydrin compounds, alcohols and mixtures thereof.

In one useful embodiment, the borate ester is a compound represented by one or more of the following formulas $(RO)_3B$, $(RO)_2B—O—B(OR)_2$, or

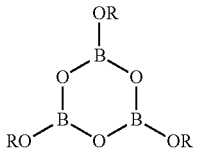

wherein each R is independently an organic group and any two adjacent R groups may together form a cyclic group. Mixtures of two or more of the foregoing may be used. In one embodiment, R is a hydrocarbyl group. The total number of carbon atoms in the R groups in each formula must be sufficient to render the compound soluble in the base oil. Generally, the total number of carbon atoms in the R groups is at least about 10, and in one embodiment at least about 12. There is no limit to the total number of carbon atoms in the R groups. However, in some embodiments, the R groups may contain for example, 10 to 100 carbon atoms, further for example, 12 to 100 carbon atoms, even further for example, 10 to 50 carbon atoms, further for example, 12 to 50 carbon atoms, even further for example 10 to 32 carbon atoms, even further for example 12-32 carbon atoms. Each R group may be the same as the other, although they may be different.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment, useful R groups include branched alkyl groups. Borate esters containing branched R groups may be formed from the reaction of a boron containing compound, such as a boric acid with a branched alcohol. Suitable branched alcohols may include any branched alcohols containing at least 10, or at least 12, carbon atoms and wherein the alcohol is branched at the 0 position or higher. Suitable alcohols may be selected from Guerbet alcohols which have substitution on the second carbon from the hydroxyl group, with the proviso that the Guerbet alcohol has at least about 10, or at least about 12 carbon atoms, for example, about 10 to about 32 carbon atoms or about 12 to about 32 carbon atoms. Useful branched alcohols may also include 2-propylheptanol, 2-butyloctanol, 2-hexyldecanol, 2-octyldodecanol, and isotridecanol. Additional useful branched alcohols include mixtures of branched isoalcohols having from 11-15 carbon atoms, for example $C_{11}$, $C_{12}$, $C_{13}$, $C_{14}$, $C_{15}$, and mixtures thereof. Commercial examples of useful alcohols include EXXAL®13 alcohol produced by ExxonMobil Chemical Co., which is a highly branched mixture of $C_{11}$, $C_{13}$, and $C_{14}$ isoalcohols; MARLIPAL® O13 alcohol produced by Sasol North America, Inc., which is a branched $C_{13}$ alcohol mixture based on hydroformylation of butane trimers; ISALCHEM® alcohols, also produced by Sasol, which are primary isomeric alcohols with alkyl chain distributions of 11 to 15 carbon atoms such as ISALCHEM® 123 A, which is an isomeric mixture of alcohols having 12 and 13 carbon atoms and ISALCHEM® 145 A, which is an isomeric mixture of alcohols having 14 and 15 carbon atoms; and SAFOL® 23 alcohol produced by Sasol North America, Inc., which is a mixture of branched and linear alcohols, where the branching on the branched alcohol is predominately higher than the 0 position, and which is produced by the hydroformylation of olefins obtained via a FischerTropsch process.

Borate esters useful in the present invention may contain one or more branched alkyl groups, which have a structure represented by $—CH_2—C(R^1)(R^2)H$ wherein $R^1$ is an alkyl group of about 7 to about 18 carbon atoms and $R^2$ is an alkyl group having fewer carbon atoms that 10. In one embodiment $R^2$ has four fewer carbon atoms than $R^1$. It should be understood that $R^1$ and $R^2$ can have any number of carbon atoms with the proviso that the branched alkyl group has at least 10, for example, at least 12 carbon atoms total. Useful alkyl groups include 2-propylheptyl, 2-butyloctyl, 2-hexyldecyl, 2-octyldodecyl, tridecyl, 2-decyl tetradecyl, 2-dodecyl hexadecyl, 2-tetradecyl octadecyl, 2-hexadecyl eicosanyl, and combinations and mixtures of the foregoing.

In one useful embodiment, the boron containing compound comprises a borate ester represented by the structure.

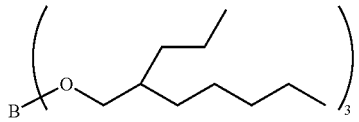

In an alternative embodiment, the lubricating grease composition of the present invention may comprise from about 0.1% to about 10% by weight, about 0.5% by weight to about 8% by weight, or from about 1% by weight to about 6% by weight, or from about 1.25% by weight to about 5% by weight, or from about 1.5% by weight to about 5% by weight of the boron-containing compound such as a borate ester as described herein, based on the total weight of the lubricating grease composition.

Other Additives

The lubricating grease composition of the present invention may also include one or more other additives. Such additives, either alone or in combination, may be present at levels of from 0% by weight to about 15% by weight, or 0% by weight to about 5% by weight, or about 0.1% to about 3% by weight of the total weight of the lubricating grease composition.

Other performance additives useful in the lubricating grease composition of the present invention include, but are not limited to, metal deactivators, viscosity modifiers, detergents, friction modifiers, anti-wear agents, corrosion inhibitors, tackifier, extreme pressure agents, anti-oxidants, and mixtures thereof. Typically, a fully-formulated grease composition will contain at least one or more of these performance additives.

Anti-oxidants may be selected from diarylamine, alkylated diarylamines, hindered phenols, molybdenum compounds (such as molybdenum dithiocarbamates), hydroxyl thioethers, trimethyl polyquinoline (e.g., 1,2-dihydro-2,2,4-trimethylquinoline), or mixtures thereof. In one embodiment the grease composition includes at least one anti-oxidant and may contain a mixture of anti-oxidants. The anti-oxidant may be present at levels of 0% by weight to about 55% by weight, or about 0.1% by weight to about 10% by weight, or about 0.5% by weight to about 5% by weight, or about 0.5% by weight to about 3% by weight, or about 0.3% by weight to about 1.5% by weight of the total weight of the lubricating grease composition.

In one embodiment, diarylamine and alkylated diarylamine used in the lubricating grease composition herein may be selected from a phenyl-α-naphthylamine (PANA), an alkylated diphenylamine, or an alkylated phenylnapthyl-amine, or mixtures thereof. In another embodiment, the alkylated diphenylamine may include di-nonylated diphenylamine, nonyl diphenyl amine, octyl diphenylamine, di-octylated diphenyl amine, or di-decylated diphenylamine. The alkylated diarylamine may include octyl, di-octyl, nonyl, di-nonyl, decyl or di-decyl phenyln-apthylamines. The alkylated diarylamine may be a tetra-alkylated diarylamine.

Hindered phenol anti-oxidants may also be useful in the lubricating grease composition of the present invention. Hindered phenol anti-oxidants often contain a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol anti-oxidants include 2,6-ditert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol anti-oxidant may be an ester. A commercially available example of a hindered phenol ester anti-oxidant is IRGANOX™ L 135 from BASF. A detailed description of suitable ester-containing hindered phenol anti-oxidant chemistry is found in U.S. Pat. No. 6,559,105.

In one embodiment, the lubricating grease composition may further comprise a tackifier. Useful tackifiers are known in the art and may include hydrogenated styrene-butadiene rubbers, ethylene-propylene copolymers, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof. Tackifiers, such as those described in U.S. Pat. No. 6,300,288 may also be useful in this invention.

In one embodiment, the lubricating grease composition may include a viscosity modifier for the base oil. In another embodiment, the base oil used may contain a viscosity modifier. Viscosity modifier useful in the present invention may be selected from polyolefins, for example, ethylene-propylene copolymers, polymethacrylates, polyacrylates, or styrene-maleic anhydride copolymers reacted with an amine.

In one embodiment, the lubricating grease composition may also comprise an overbased metal-containing detergent. The overbased metal-containing detergent may be a calcium, sodium, or magnesium overbased detergent.

The overbased metal-containing detergent may be selected from the group consisting of non-sulfur containing phenates, sulfur containing phenates, sulfonates, salixarates, salicylates, and mixtures thereof, or borated equivalents thereof. The overbased metal-containing detergent may be may be selected from the group consisting of non-sulfur containing phenates, sulfur containing phenates, sulfonates, and mixtures thereof. The overbased detergent may be borated with a borating agent such as boric acid such as a borated overbased calcium, sodium, or magnesium sulfonate detergent, or mixtures thereof.

In one embodiment, the lubricating grease composition may contain a friction modifier. The friction modifier may be present at levels of 0% to about 6% by weight, or about 0.01% by weight to about 4% by weight, or about 0.05% by weight to about 2% by weight, or about 0.1% by weight to about 2% by weight of the total weight of the lubricating grease composition.

Friction modifiers may include materials such as sulfurized fatty compounds and olefins, molybdenum di alkyldithiophosphates, molybdenum dithiocarbamates, or other oil soluble molybdenum complexes. Commercially available friction modifiers include MOLYVAN® 855 (commercially available from Vanderbilt Chemicals LLC) or SAKURA-LUBE® S700 or SAKURA-LUBE® S710 (commercially available from Adeka, Inc.).

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of LUVODOR® MB or LUVODOR® MBO (commercially available from Lehmann and Voss GmbH). The oil soluble molybdenum complexes may be present at 0% by weight to 5% by weight, or 0.1% by weight to 5% by weight or 1% by weight to 3% by weight of the total weight of the grease composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

In one embodiment, the lubricating grease composition comprises an anti-wear agent. Examples of suitable anti-wear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis(S-alkyldithiocarbamyl) disulfides, and oil soluble phosphorus amine salts. In one embodiment the grease composition may further include metal dihydrocarbyldithiophosphates (such as zinc dialkyldithiophosphates).

In one embodiment, the lubricating grease composition comprises an extreme pressure agent. The extreme pressure agent may be a compound containing sulfur and/or phosphorus and/or nitrogen. Examples of an extreme pressure agents include a polysulfide, a sulfurized olefin, a thiadiazole, or mixtures thereof.

Examples of a thiadiazole extreme pressure agent include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-di mercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10.

The 2,5-dimercapto-1,3,4-thiadiazole may be 2,5-dioctyl dithio-1,3,4-thiadiazole, or 2,5-dinonyl dithio-1,3,4-thiadiazole.

In one embodiment, polysulfide extreme pressure agents are used wherein at least 50% by weight of the polysulfide molecules are a mixture of tri- or tetra-sulfides. In other embodiments at least 55% by weight, or at least 60% by weight of the polysulfide molecules are a mixture of tri- or tetra-sulfides.

In one embodiment, a polysulfide extreme pressure agent may include a sulfurized organic polysulfide from oils, fatty acids or ester, olefins or polyolefins. Oils which may be sulfurized include natural or synthetic fluids such as mineral oils, lard oil, carboxylate esters derived from aliphatic alcohols and fatty acids or aliphatic carboxylic acids (e.g., myristyl oleate and oleyl oleate), and synthetic unsaturated esters or glycerides. Fatty acids which may be sulfurized include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

Polysulfide extreme pressure agents also may include sulfurized olefins derived from a wide range of alkenes. The alkenes typically have one or more double bonds. The sulfurized olefins in one embodiment contain 3 to 30 carbon atoms. In other embodiments, sulfurized olefins contain 3 to 16, or 3 to 9 carbon atoms. In one embodiment the sulfurized olefin includes an olefin derived from propylene, isobutylene, pentene or mixtures thereof. In one embodiment, the polysulfide comprises a sulfurized polyolefin derived from polymerizing by known techniques an olefin as described above.

In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present in the lubricating grease composition at a level of 0% by weight to about 5% by weight, about 0.01% by weight to about 4% by weight, about 0.01% by weight to about 3.5% by weight, about 0.05% by weight to about 3% by weight, about 0.1% by weight to about 1.5% by weight, or about 0.2% by weight to about 1% by weight of the lubricating grease composition.

In one embodiment, the lubricating grease composition may also comprise a metal deactivator. Useful metal deactivators may include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Corrosion inhibitors useful for a mechanical device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

In one embodiment, the lubricating grease composition of the present invention may comprise:

(a) from about 0.1% by weight to about 10.0% by weight of a boron containing compound (b) 0.1% by weight to 45% by weight of a grease thickener;

(c) 0% by weight to 10% by weight of other performance additives; and (d) balance of an oil of lubricating viscosity.

INDUSTRIAL APPLICATION

The lubricating grease composition of the present invention may be employed to in applications requiring a grease composition with improved temperature resistance for mechanical devices, over and above the temperature at which a simple soap could satisfactorily perform.

In an embodiment, the present technology provides a method of operating a mechanical device comprising A) supplying to the mechanical device a lubricating grease composition comprising 1) an oil of lubricating viscosity, 2) a metallic soap thickener, and 3) at least one boron containing compound and B) operating the mechanical device.

The additive composition and lubricating grease compositions may therefore be employed on a variety of mechanical devices, for example, bearings or joints. The mechanical device bearing, or joint may be within, for example, an automotive power transmission, a driveline device, a vehicle suspension or steering system, or a hydraulic system. In one embodiment the mechanical device may be an automobile drive shaft. The mechanical device may contain a constant velocity joint or a universal joint.

The lubricating grease composition of the invention may include a lithium soap grease made with a 12-hydroxycarboxylic acid (a simple soap grease), an anhydrous calcium soap grease, or mixed soap greases of lithium, calcium, and/or sodium.

The grease composition may also be useful for a low noise grease which are known and typically used in rolling element bearing applications such as electric motors, pumps or compressors.

The invention herein is useful for improving the temperature resistance performance of metallic soap thickened greases which may be better understood with reference to the following examples.

The following examples provide illustrations of the invention. These examples are non-exhaustive and are not intended to limit the scope of the invention.

Preparation of Borate Ester

To a 500 mL, 3-neck round-bottomed flask equipped with an overhead mechanical stirrer, a Dean Stark trap, a Friedrich's condenser, a thermocouple, and a vapor-space nitrogen purge past the Dean Stark trap and condenser, boric acid and the corresponding alcohols are charged. Vapor-space nitrogen purge is set to 0.5 scfh. The slurry is slowly heated to 180° C. over a period of about 7 hours. Water is collected in the Dean Stark trap. The solid boric acid dissolves during the course of the reaction, giving a clear liquid. The product is filtered through filter paper to remove a small amount of trace haze. The product was a clear, colorless liquid. Borate Ester A: Reaction product of 1 eq. of boric acid and 3 eq. of 2-ethyl hexanol. Borate Ester B: Reaction product of 1 eq. of boric acid and 3 eq. of 2-propyl heptanol.

Lubricating Grease Examples 1 to 8 (EX1 to EX8)

A series of metallic soap thickened greases in base oil of lubricating viscosity are prepared containing the additives described above. A simple lithium soap base grease containing, as a base oil, 600 SUS Group I Paraffin Oil (112 $mm^2/s$ at 40° C.) and 9.5% wt lithium 12-hydroxystearate soap was cut with more of the base oil to make an NLGI #2 grease (EX1). Three further samples were prepared, one using Borate Ester A as a dropping point enhancer (EX2) and two using the new borate compound, Borate Ester B, which are inventive examples EX3 (identical treat rate to EX2) and EX4 (identical boron content to EX2). As can be seen from the table the new borate is equally effective as existing compounds when used in lithium soap grease, but without the alcoholic odor of the existing boron additive.

| Ingredient | Test method | Comparative EX1 | Comparative EX2 | Inventive EX3 | Inventive EX4 |
|---|---|---|---|---|---|
| Base Grease | | 60 | 60 | 60 | 60 |
| Additional Base Oil | | 40 | 37 | 37 | 36.07 |
| Borate Ester A | | | 3.0 | | |
| Borate Ester B | | | | 3.0 | 3.93 |
| Odor | | Slight oily | Strong Alcoholic | Slight oily | Slight oily |
| Worked Penetration | ASTM D1403 | 275 | 275 | 285 | 285 |
| Dropping Point (° C.) | ASTM D2265 | 196 | 279 | 275 | 273 |

A simple anhydrous calcium soap base grease containing, as a base oil, Nynas BNS 150 Naphthenic API Group V base oil (145 $mm^2/s$ at 40° C.) mixed with 600 SUS Chevron API Group II base oil (115 $mm^2/s$ at 40° C.) and 12.0% wt calcium 12-hydroxystearate soap was cut with more of the base oil to make it an NLGI #2 grease (EX5). Three further samples were prepared, one using Borate Ester A as dropping point enhancer (EX6) and two using Borate Ester B, inventive examples EX7 (identical treat rate to EX6) and EX8 (identical boron content to EX6). As can be seen from the table the new borate is equally effective as existing compounds when used in calcium 12-hydroxystearate soap grease, but without the alcoholic odor of the existing boron additive.

| Ingredient | Test method | Comparative EX5 | Comparative EX6 | Inventive EX7 | Inventive EX8 |
|---|---|---|---|---|---|
| Base Grease | | 70 | 70 | 70 | 70 |
| Additional Base Oil | | 30 | 27 | 27 | |
| Borate Ester A | | | 3.0 | | |
| Borate Ester B | | | | 3.0 | 3.93 |
| odor | | Slight oily | Strong alcoholic | Slight oily | Slight oily |
| Worked Penetration | ASTM D1403 | 285 | 295 | 295 | 295 |
| Dropping Point (° C.) | ASTM D2265 | 160 | 170 | 163 | 174 |

It is known that some of the materials described above may interact in the final formulation, so that the components of the final formulation may be different from those that are initially added. The products formed thereby, including the products formed upon employing lubricating grease compositions of the present invention in its intended use, may not be susceptible of easy description. Nevertheless, all such modifications and reaction products are included within the scope of the present invention; the present invention encompasses lubricating grease compositions prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating grease composition comprising:

(a) an oil of lubricating viscosity, and (b) a metallic soap thickener (c) 0.1% by weight to 6% by weight of a borate ester comprising at least one alkyl group wherein the alkyl group is a 2-propylheptyl group.

2. A lubricating grease composition comprising:

(a) an oil of lubricating viscosity, and (b) a metallic soap thickener (c) 0.1% by weight to 6% by weight of a borate ester comprising at least two alkyl groups that are 2-propylheptyl groups.

3. The lubricating grease composition of claim 1 wherein the borate ester is represented by one or more of the formulas $(RO)_3B$, $(RO)_2B—OB(OR)_2$, or

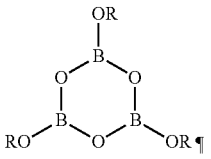

wherein each R is a 2-propylheptyl group.

4. A lubricating grease composition comprising:

(a) an oil of lubricating viscosity, and (b) a metallic soap thickener (c) 0.1% by weight to 6% by weight of a borate ester comprising a material represented by the structure

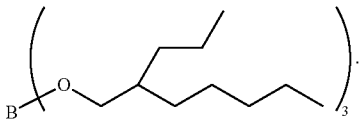

5. The lubricating grease of claim 1 wherein the metallic soap is reaction of an alkali or alkaline earth metal with a fatty acid.

6. The lubricating grease composition of claim 5 wherein the alkali metal is lithium.

7. The lubricating grease of claim 5 wherein the alkaline earth metal is calcium.

8. The lubricating grease of claim 5 wherein the fatty acid comprises a derivative of castor oil.

9. The lubricating grease of claim 5 wherein the fatty acid comprises a 12-hydroxycarboxylic acid.

10. The lubricating grease of claim 9 wherein the 12-hydroxycarboxylic acid is 12-hydroxystearic or ricinoleic, or mixtures thereof.

11. The lubricating grease of claim 1 wherein the lubricating grease comprises: 0.1% by weight to 45% by weight of the metallic soap thickener.

12. The lubricating grease of claim 1 further comprising one or more additives.

13. A method for lubricating a mechanical device, comprising supplying thereto the lubricating grease of claim 1.

14. The lubricating grease of claim 2 wherein the lubricating grease comprises: 0.1% by weight to 45% by weight of the metallic soap thickener.

15. The lubricating grease of claim 4 wherein the lubricating grease comprises: 0.1% by weight to 45% by weight of the metallic soap thickener.

* * * * *